US006666717B1

(12) United States Patent
Choy

(10) Patent No.: US 6,666,717 B1
(45) Date of Patent: Dec. 23, 2003

(54) STRUCTURE OF HORIZONTAL TYPE DIMM CONNECTOR FOR DENSE ARRANGEMENT

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/205,691

(22) Filed: Jul. 25, 2002

(51) Int. Cl.[7] ..... H01R 13/60
(52) U.S. Cl. ..... 439/541.5; 439/328; 439/570
(58) Field of Search ..... 439/541.5, 159, 439/160, 325–328, 567, 631, 637

(56) References Cited

U.S. PATENT DOCUMENTS 5,641,295 A * 6/1997 Koyama ..... 439/326
5,964,606 A * 10/1999 Choy ..... 439/160
6,159,040 A * 12/2000 Chang et al. ..... 439/541.5
6,176,737 B1 * 1/2001 Choy ..... 439/541.5
6,554,641 B1 * 4/2003 Wu ..... 439/541.5

* cited by examiner

*Primary Examiner*—Hien Vu
(74) *Attorney, Agent, or Firm*—Wei Te Chung

(57) ABSTRACT

A pair of horizontal type connectors are densely arranged in a front-to-back direction. The front connector including an insulative housing with a horizontally forwardly facing mating port. A pair of piers forwardly extend from two opposite ends of the front connector. The rear connector including an insulative housing with a horizontally forwardly facing mating port. A pair of piers forwardly extend from two opposite ends of the rear connector. The front connector includes a pair of cutouts around a rear portion in alignment with the corresponding piers of the front connector, respectively. The cutout is configured to allow the front end of the corresponding pier of the rear connector located thereabove while without interference therewith when the front connector is upwardly moved.

3 Claims, 7 Drawing Sheets

STRUCTURE OF HORIZONTAL TYPE DIMM CONNECTOR FOR DENSE ARRANGEMENT

BACKGROUND OF THE INVENTION

1. Field of the Invention

The invention relates to horizontal type DIMM (Dual In-line Memory Module) connectors, and particularly to dense arrangement of multiple horizontal type DIMM connectors.

2. The Related Art

U.S. Pat. No. 5,964,606 having the same inventor and the same assignee with the invention, discloses structures of identical slanted type DIMM connectors for dense arrangement. Understandably, the slanted type DIMM connector is to replace the vertical type DIMM connector, e.g., U.S. Pat. No. U.S. Pat. No. 6,227,887, for reducing the height/profile of the module/connector assembly. Anyhow, under some situations, the slanted type DIMM connectors are still unable to meet the strict low profile requirements because the DIMM module, which is inserted into the DIMM connector, obliquely upwardly extends from the DIMM connector thereby still occupying significant space in the vertical direction. Thus, the horizontal type DIMM connectors were provided to meet such requirements. Such conventional horizontal type DIMM connector is only for single use without concerns about usage of more than one horizontal type DIMM connectors. The invention is to provide a pair of horizontal type DIMM connectors which are adapted to be densely arranged in a front-to-back direction to reach the minimum height/profile in the vertical direction, the minimum space in the horizontal direction, and free release from the mother board for each individual horizontal type DIMM connector without obstacle during a de-soldering/rework process as pursued in the aforementioned U.S. Pat. No. 5,964,606.

SUMMARY OF THE INVENTION

According to an aspect of the invention, a first horizontal type DIMM connector includes a first insulative housing defining a first slot with a plurality of first contacts by two sides of the first slot. A pair of first piers extend forwardly from two opposite ends of the first housing, respectively. A pair of ejectors are horizontally pivotally mounted on the pair of first piers, respectively. A second horizontal type DIMM connector includes a second insulative housing defining a second slot with a plurality of second contacts by two sides of the second slot. A pair of second piers extends forwardly from two opposite ends of the first housing. A pair of ejectors are horizontally pivotally mounted on the pair of second piers, respectively. The second housing is positioned at the rear upper position with regard to the first housing.

The bottom face of the second housing is spaced from the upper face of the first housing with a distance so as not to have the module inserted into the second slot interfere with either the first housing or another module inserted into the first housing.

The rear portion of the first housing opposite to the first pier defines a cutout which is dimensioned, along the lengthwise direction of the first and second housings, larger than the front end of the second pier, and along the front-to-back direction close to the bottom of the ejector of the first connector, so that the front end of the second pier is structurally located above while being able to be compliantly vertically receiveably projected within said cutout when said second connector is densely/closely positioned behind the first connector.

DETAILED DESCRIPTION OF THE PRESENTLY PREFERRED EMBODIMENTS

Figure 1:
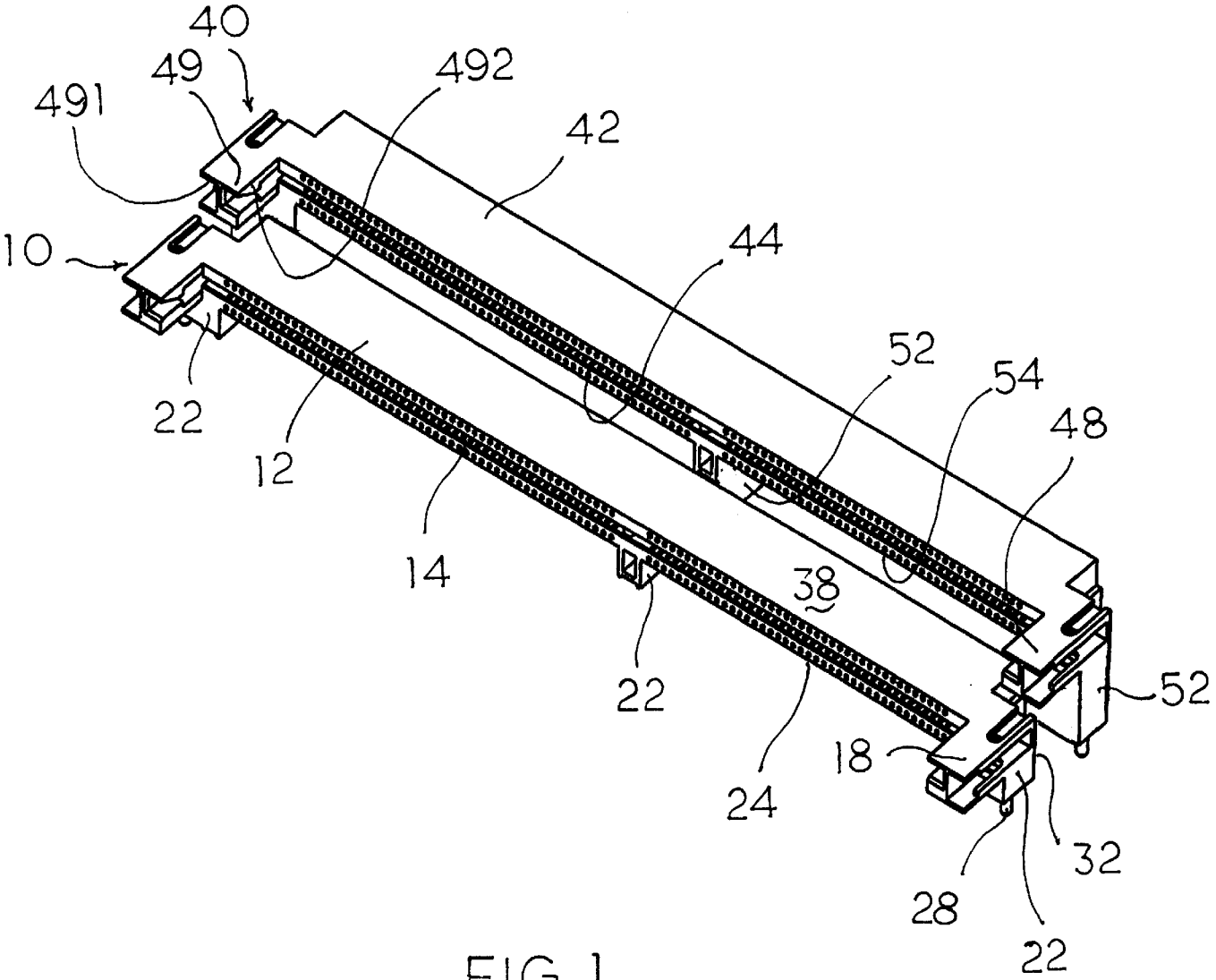
FIG. 1 is a perspective view of a pair of connectors without showing ejectors and contacts thereof according to the invention.
Figure 2:
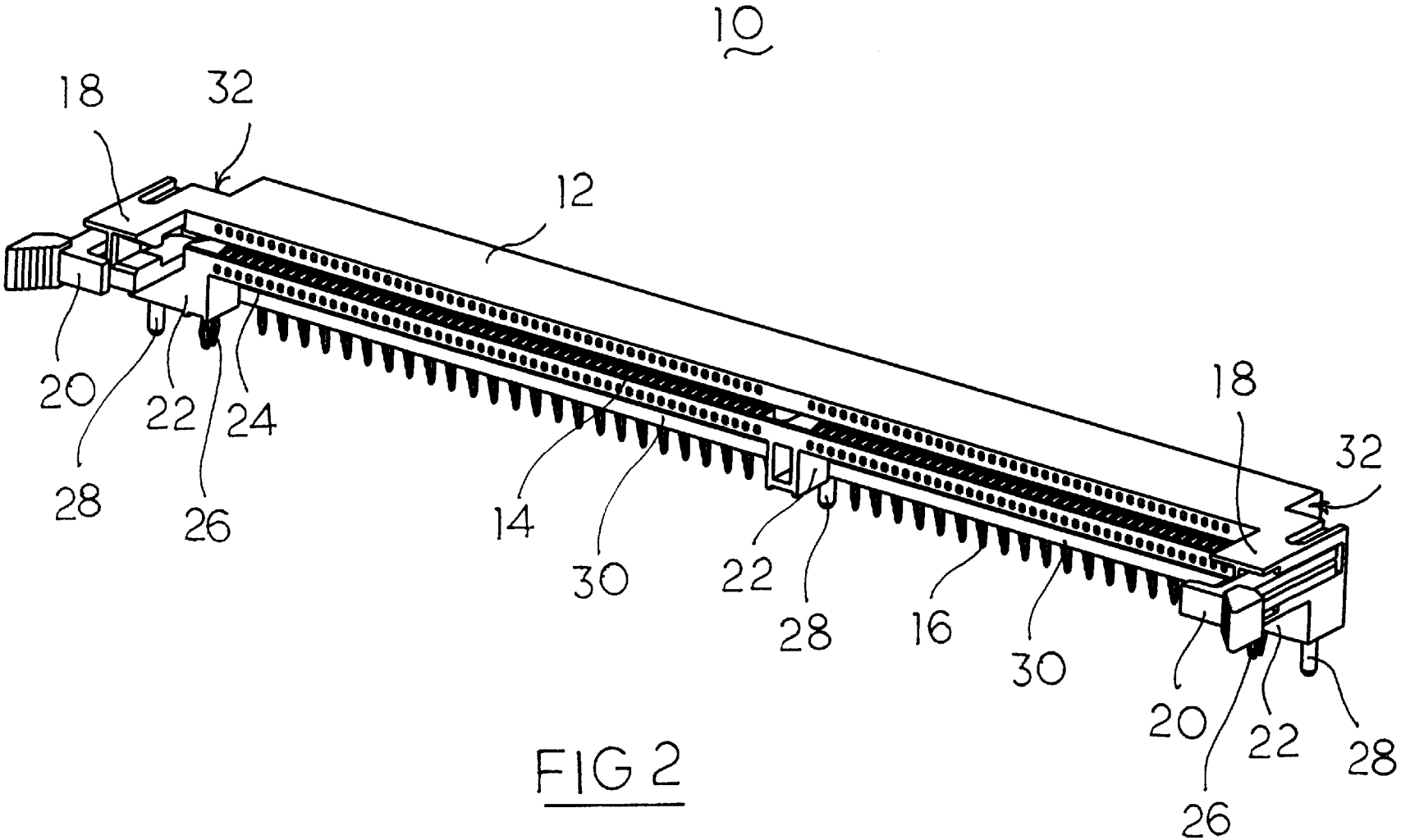
FIG. 2 is a perspective view of the first connector of FIG. 1.
Figure 3:
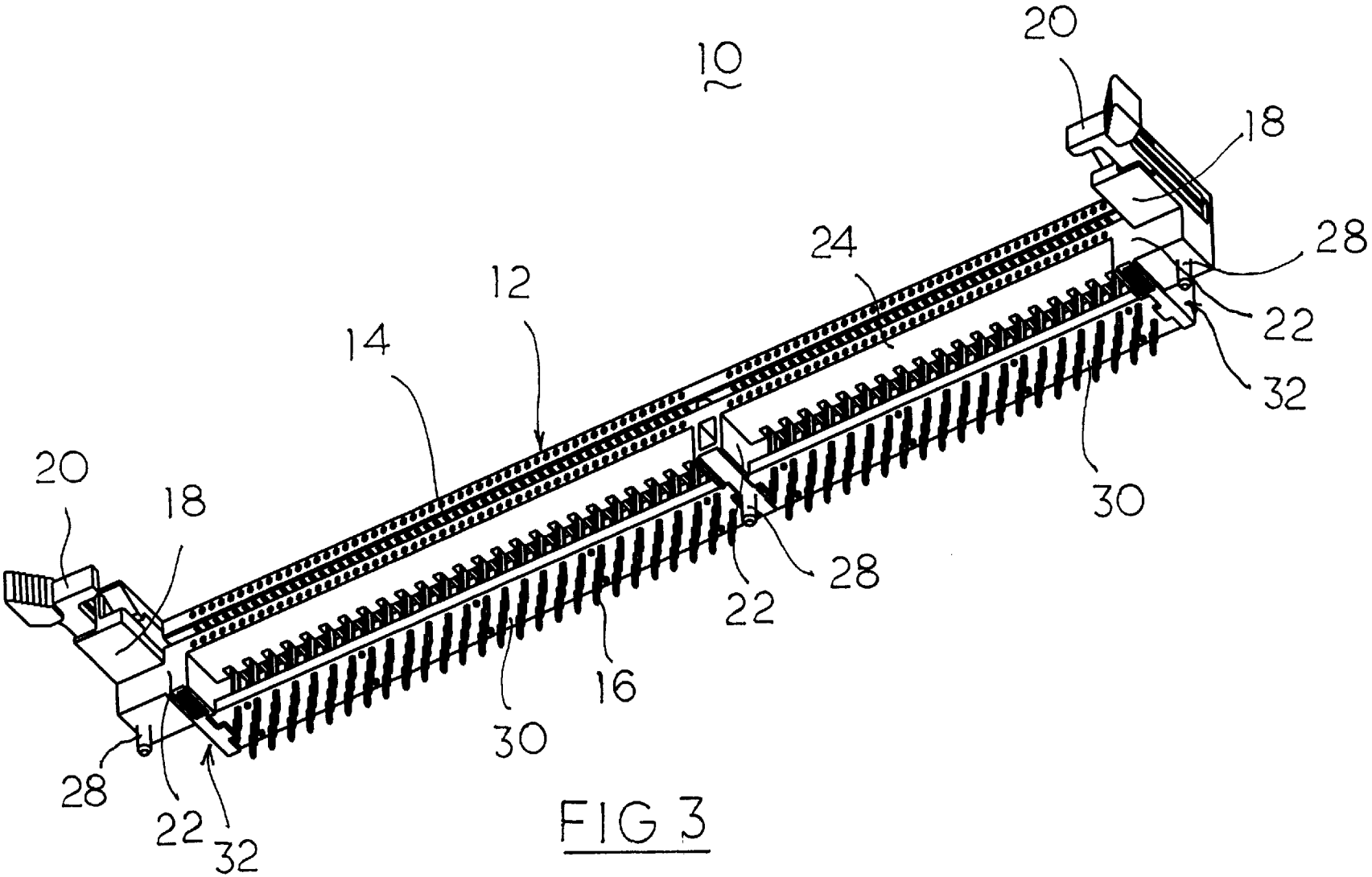
FIG. 3 is another perspective view of the first connector of FIG. 1 without showing the board locks thereof.
Figure 4:
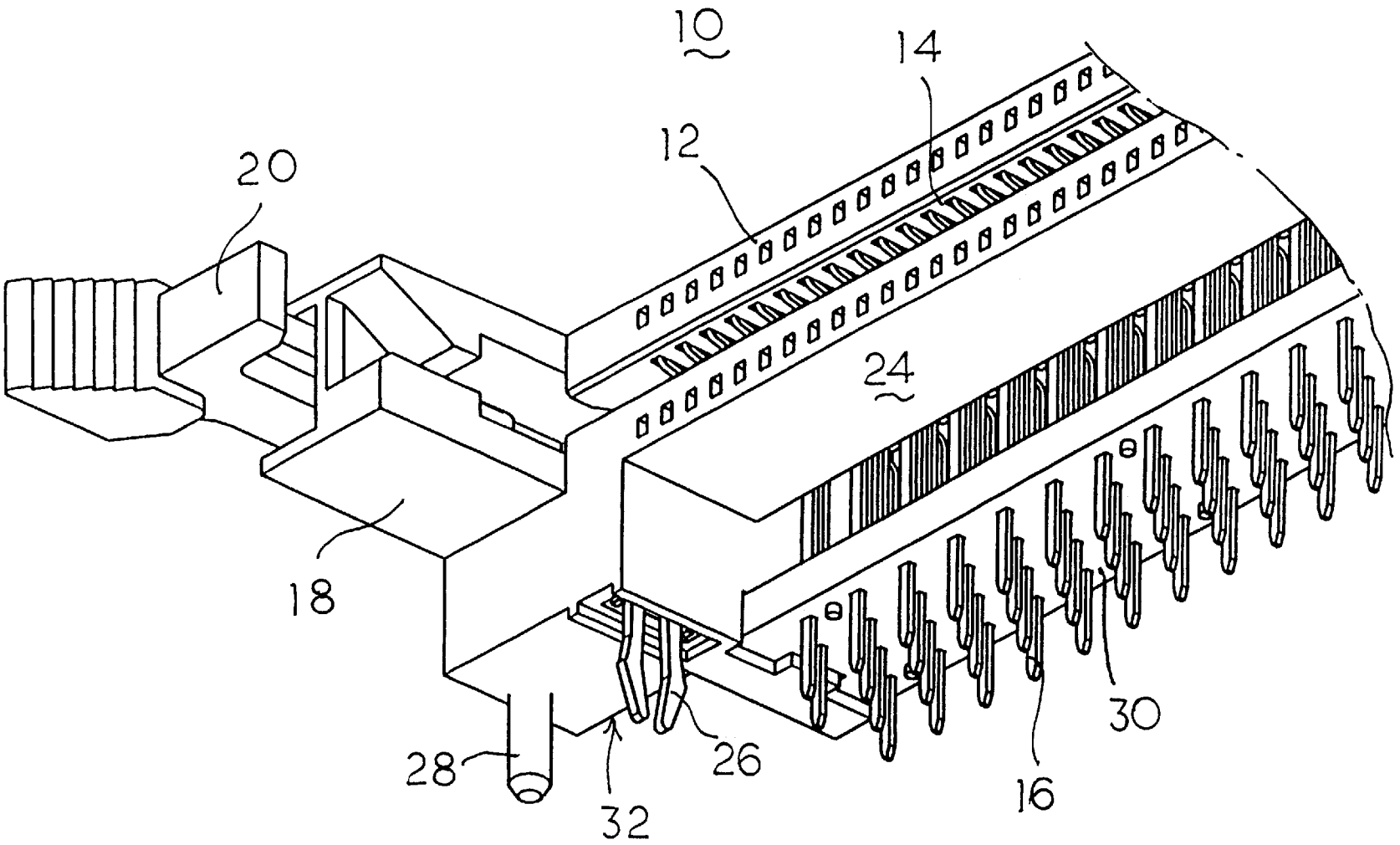
FIG. 4 is a partially enlarged perspective view of the first connector of FIG. 1.
Figure 5:
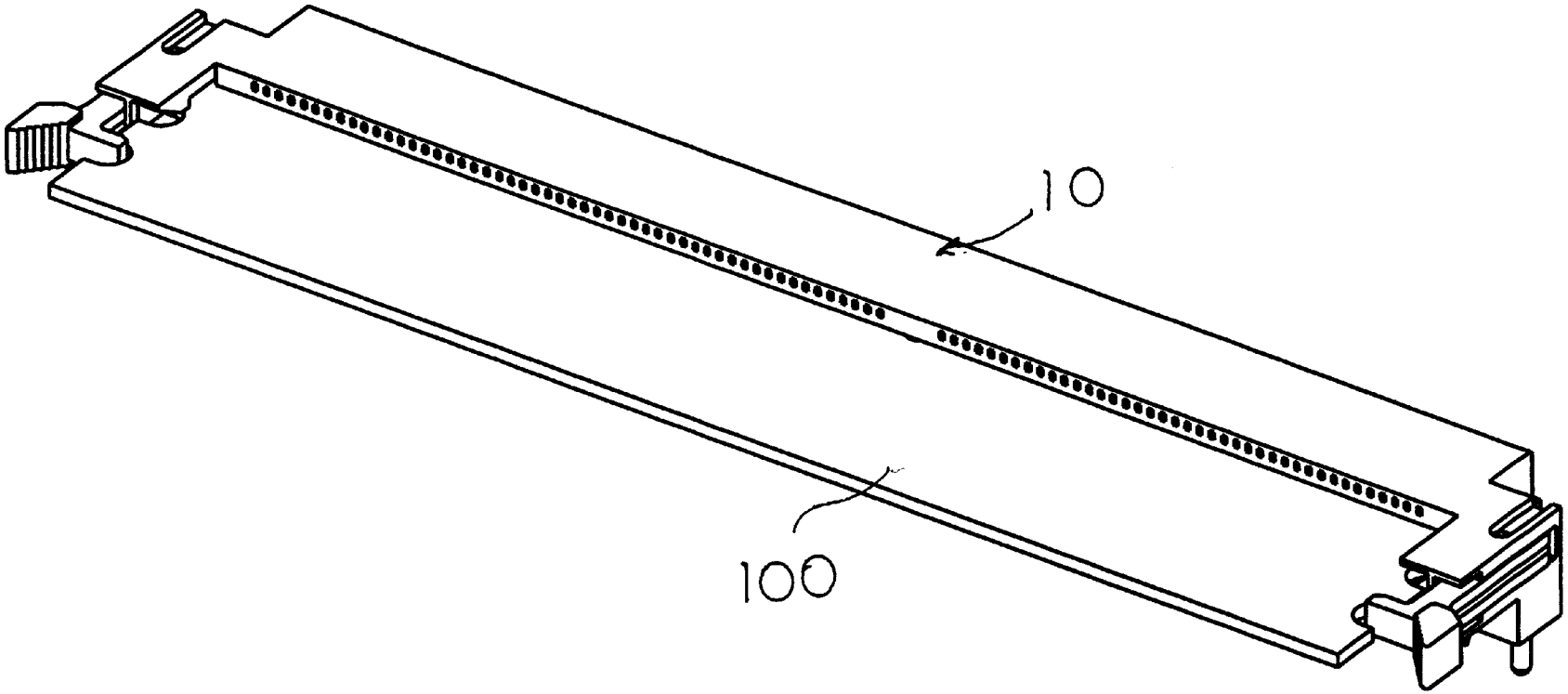
FIG. 5 is a perspective view of the first connector of FIG. 1 with the inserted DIMM module therein.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–6 wherein a first horizontal type DIMM connector 10 includes a first insulative housing 12 with an elongated body defining a first central slot 14 with a plurality of first contacts 16 by two sides of the first central 14.

A pair of first piers 18 forwardly extend from two opposite ends of the first housing 12, respectively. A pair of first ejectors 20 are pivotally mounted on the pair of first piers 18, respectively. Three first standoffs 22 are respectively located on a bottom face 24 of the first housing 12 for raising up the first housing 12 so that it is easy to assemble the DIMM module 100 into the first central slot 14 of the first connector 10 without interference with the components of the mother board (not shown) on which the first connector is mounted.

The board locks 26 and the posts 28 are optionally extend downwardly from the first standoffs 22 for retaining the first connector 10 on the mother board (not shown). Two spacer 30 are provided on a rear portion of the first housing 12 for aligning tails of the first contacts 16.

A second connector 40 is located around a rear upper portion of the first connector 10. The second connector 40 includes a second insulative housing 42 with an elongated body defining a second central slot 44 with a plurality of second contacts 46 by two sides of the second central slot 44.

A pair of second piers 48 forwardly extend from two opposite ends of the second housing 42, respectively. A pair of second ejectors 50 are pivotally mounted on the pair of second piers 48. Three second standoffs 52 are respectively located on a bottom face 54 of the second housing 42 for raising up the second housing 42. The second standoffs 52 is higher than the first standoffs 22 so that it is easy to assembly another DIMM module 100 into the second central slot 44 of the second connector 40 without interference with either the first housing 12 or the associated DIMM module 100 received in the first central slot 14. The second connector 30 also includes structures of the posts/board locks, and the spacers, which perform the similar functions as those in the first connector 10.

Figure 6:
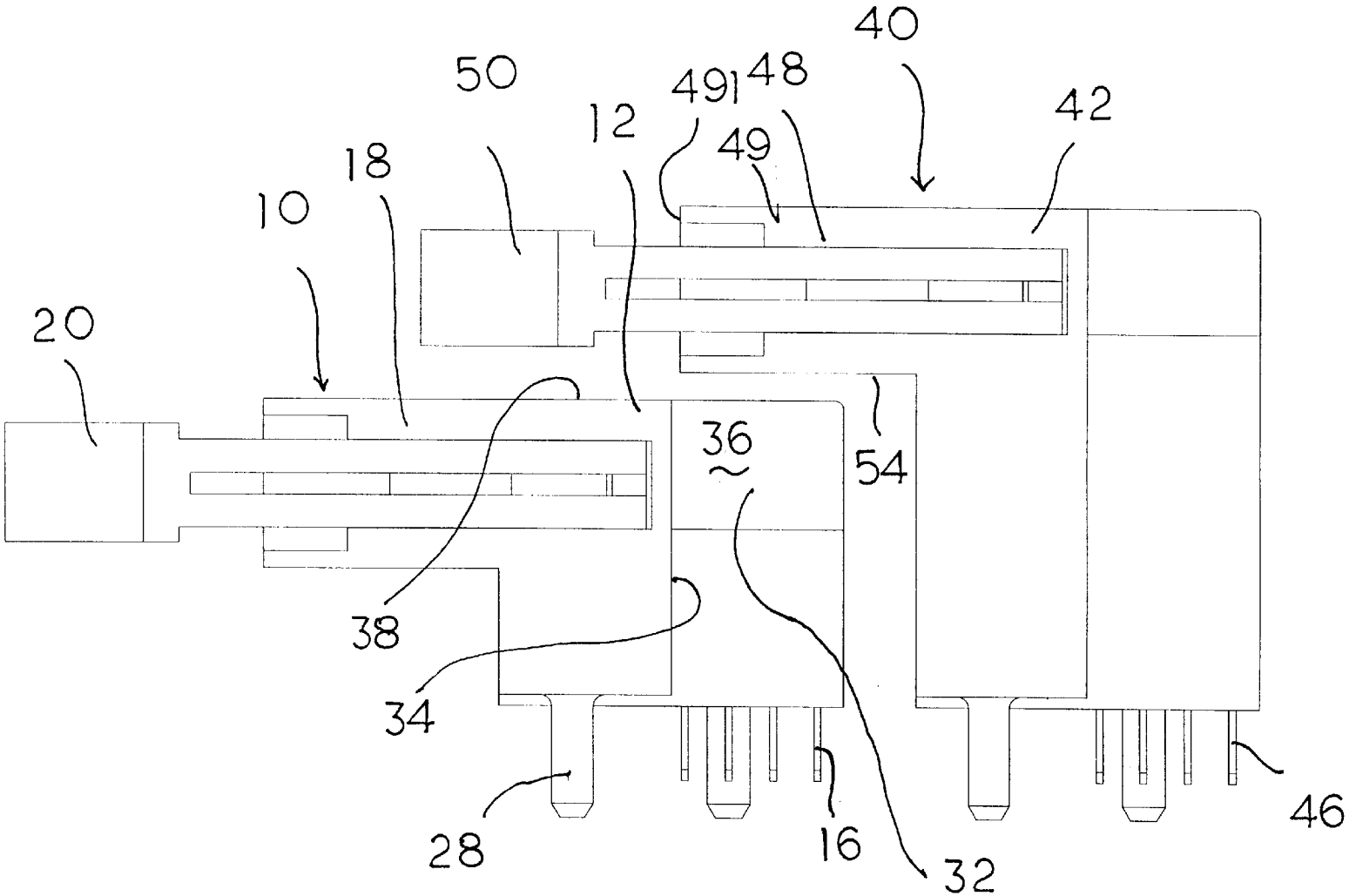
FIG. 6 is a side view of the pair of connectors of FIG. 1 without showing the board locks thereof.

The first housing 12 defines in the rear portion a pair of cutouts 32 opposite to the first pair of piers 18 in a front-to-back direction. The cutout 32 is dimensioned to be larger than the front end of the corresponding second pier 48 in a lengthwise direction of the first housing 12 and the second housing 42. Also, the cutout 32 is recessed close to the bottom of the first ejector 20 in a front-to-back direction. Under this situation, the second connector 40 is able to be located behind the first connector 10 as close as possible to have the front end 49 of the second pier 48 structurally located above while being compliantly vertically receivebly projected within the corresponding cutout 32 without interference. Referring to FIGS. 1 and 6, the surface 34 beside the cutout 32 is located in front of the edge 491 of the front end 49 of the second pier 48 along the front-to-back direction, and the surface 36 beside the cutout 32 is located more inwardly in comparison with the inner edge 492 of the front end 49 of the second pier 48. At the same time, the bottom face 54 of the second housing 42 is spaced from the top face 38 of the first housing 12 with a distance so as to have the module 100 inserted therein will not interfere with either the first housing 12 or the module 100 inserted in the first housing 12.

Figure 7:
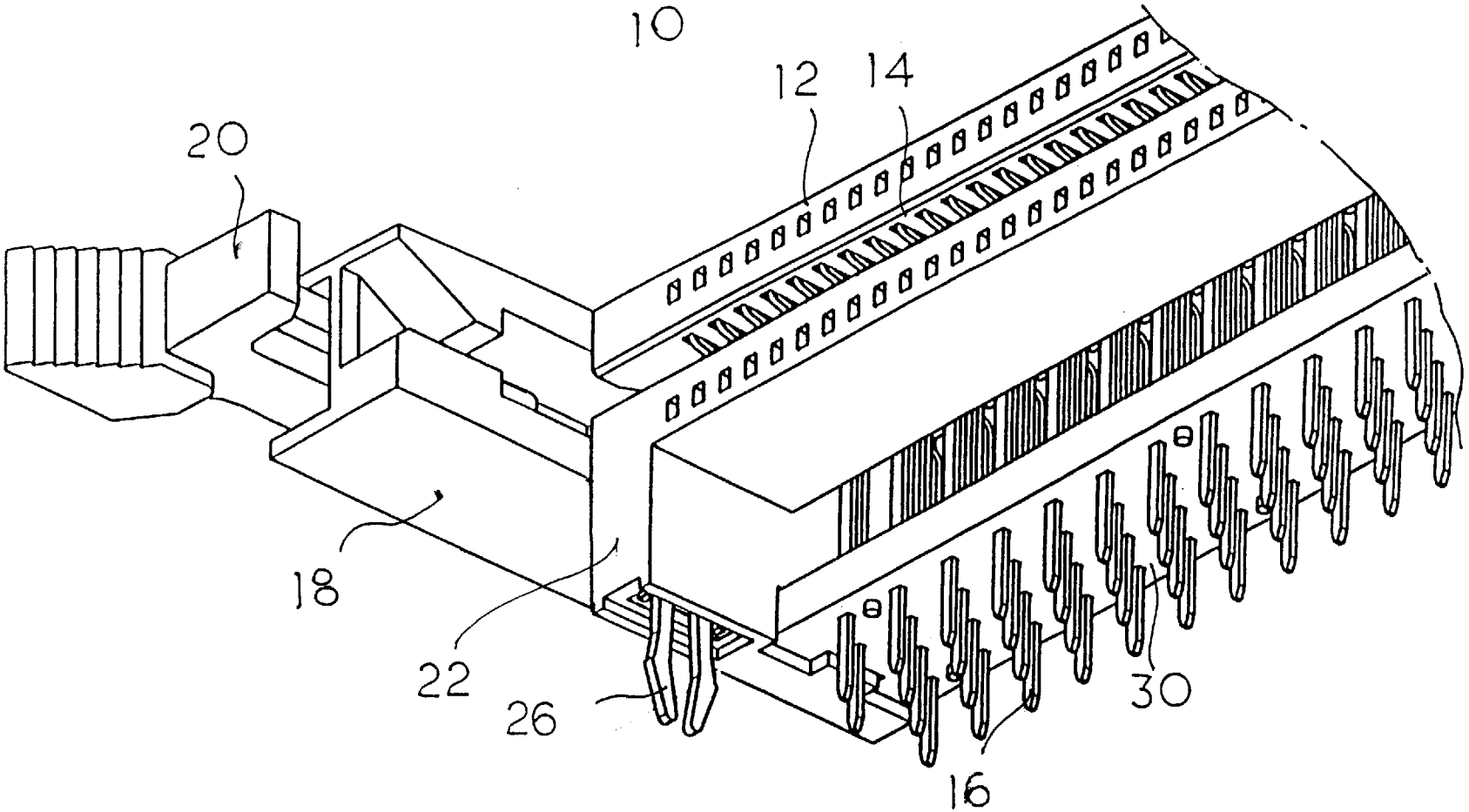
FIG. 7 is a partially enlarged perspective view of the first connector according to another embodiment of the invention.

It is noted that in this embodiment, both the first connector 10 and the second connector 40 are not identical while sharing most same portions for saving molding cost. In other words, the differences may only include heights of the standoffs and the tail lengths of the contacts. It is also noted that as mentioned only one of the board lock 26 and the post 28 may be required as shown in FIG. 7 wherein the post 28 and a portion of the associated standoffs 22 are removed.

Similar to the aforementioned U.S. Pat. No. 5,964,606, the first connector 10 and the second connector 40 can be densely/closely arranged together in a front-to-back direction while the first connector 10 may be removed from the mother board for rework without being disturbing the second connector 40 thereabouts. Understandably, the ejectors 50 of the second connector 40 should be in an open position during removal of the first connector 10. Different from the slanted type DIMM connectors aforementioned U.S. Pat. No. 5,964,606, in the invention the first connector 10 and the second connector 40 are not identical with each other and positioned at two different levels while such slanted DIMM connectors are identical with each other and essentially located at the same level.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim.

Therefore, person of ordinary skill in this field are to understand that all such equivalent structures are to be included within the scope of the following claims.

I claim:

1. An electrical connector assembly comprising:

discrete and different first and second horizontal type connectors;

said first connector including:

a first insulative housing defining a first horizontal forwardly facing slot with a plurality of first contacts by two sides thereof;

a pair of first horizontal piers extending forwardly from two opposite ends of the first housing;

first standoffs extending perpendicularly and downwardly from a bottom face of the first housing and each of the first standoffs including a post extending downwardly therefrom;

said second connector including:

a second insulative housing defining a second horizontal forwardly facing slot with a plurality of second contacts by two sides thereof;

a pair of second horizontal piers extending forwardly from two opposite ends of the second housing;

second standoffs extending perpendicularly and downwardly from a bottom face of the second housing and each of said second standoffs including a post extending downwardly therefrom, said second housing positioned densely behind and above and in front-to-back alignment with the first housing;

a pair of first cutouts formed at two opposite ends of a rear portion of the fist housing opposite to the corresponding first piers, respectively, and each of said first cutouts being dimensioned to be larger than a front end of the corresponding second pier in a lengthwise direction of the first housing; wherein said front end of the second pier is structurally located above the corresponding first cutout while being receiveably vertically projected within the first cutout without interference; wherein the second standoffs are higher than the fist standoffs; wherein the second connector is elevated above the first connector; wherein a pair of second cutouts are formed in the second housing similar to the first cutouts in the first housing; wherein the bottom face of the second housing is vertically spaced from a top face of the first housing; wherein a pair of ejectors are pivotally mounted on the corresponding piers, respectively.

2. The assembly as defined in claim 1, wherein the fist pier and the second pier are dimensionally similar to each other.

3. The assembly as defined in claim 1, wherein said cutout is recessed in a back-to-front direction closed to a bottom of the ejector.

* * * * *